US005920908A

United States Patent [19]

Widdemer

[11] Patent Number: 5,920,908

[45] Date of Patent: Jul. 13, 1999

[54] WATERPROOF BREATHABLE GOLF GLOVE WITH SINGLE SEAM CONSTRUCTION

[76] Inventor: John D. Widdemer, 109 First Ave., Gloversville, N.Y. 12078

[21] Appl. No.: 08/933,621

[22] Filed: Sep. 9, 1997

Related U.S. Application Data

[60] Provisional application No. 60/025,964, Sep. 9, 1996.

[51] Int. Cl.[6] ..... A41D 19/00; A41D 19/02

[52] U.S. Cl. ..... 2/161.2; 2/159; 2/161.1; 2/167; 2/169

[58] Field of Search ..... 2/159, 161, 161.1, 2/161.2, 161.6, 161.7, 163, 169, 167, 161.3, 161.8, 164, 16; 223/78; 66/174; D2/616, 617, 618

[56] References Cited

U.S. PATENT DOCUMENTS

| | | | |
|---|---|---|---|
| 2,719,980 | 10/1955 | Haupt et al. | 2/159 |
| 4,107,840 | 8/1978 | Kupperman et al. | 2/161 |
| 5,119,512 | 6/1992 | Dunbar et al. | 2/167 |
| 5,123,119 | 6/1992 | Dube | 2/169 |
| 5,251,335 | 10/1993 | DeFusco | 2/159 |
| 5,682,613 | 11/1997 | Dinatale | 2/159 |
| 5,706,519 | 1/1998 | Cooper | 2/161.1 |
| 5,799,332 | 9/1998 | Goodwin | 2/159 |

*Primary Examiner*—John J. Calvert
*Assistant Examiner*—Gary L. Welch
*Attorney, Agent, or Firm*—Aufrichtig Stein & Aufrichtig, P.C.

[57] ABSTRACT

The invention is generally directed to a waterproof, breathable glove which is cut from a Lycra based synthetic leather formed by coating knitted Lycra fabric with a film of polyurethane. It is necessary that the Lycra base have controlled stretch in both length and width in order for the two piece construction to achieve the skin tight exact fit required by golfers. The stretch in width should be about 100% and in length about 75% which allows the two piece glove to conform exactly to a wearer's hand. The two cut pieces are joined together with one common seam either by laser bonding or heat bonding. The two pieces can also be joined by sewing but in that case it is necessary to seal the single seam which is less desirable but, still practical, unlike seam sealing an eight piece glove.

12 Claims, 1 Drawing Sheet

WATERPROOF BREATHABLE GOLF GLOVE WITH SINGLE SEAM CONSTRUCTION

This Application claims benefit of Provisional Application No. 60/025,964 filed Sep. 9, 1996.

BACKGROUND OF THE INVENTION

The invention relates, in general, to the field of glove design and, more particularly to an improved golf glove for men and women which is waterproof yet breathable for comfort. The waterproof breathable golf glove is designed with only one continuous seam which allows the glove to be constructed in two exactly equal halves which can, when using laser or heat bondable synthetic materials, be automatically joined with a waterproof seam.

Prior golf gloves are constructed of at least eight separate parts: palm and back (either one or two pieces), six fourchette pieces (which form the finger sides) and a thumb piece. When these parts are sewn together they form a complexity of seams which are impractical or impossible to waterproof by normal methods which include seam sealing with glue-like substances or taping. Either process is prohibitively expensive and results in a bulky, stiff glove undesirable for playing golf.

Waterproof, breathable golf gloves are much desired because golf is being played more and more in rainy conditions as golf courses become more crowded. But wet hands are both uncomfortable and also tend to slip inside a golf glove. The waterproof, breathable golf glove which is provided in pairs keeps a golfer's hands dry for accurate club control and also for comfort.

SUMMARY OF THE INVENTION

The invention is generally directed to a waterproof, breathable glove which is cut from a Lycra based synthetic leather formed by coating knitted Lycra fabric with a film of polyurethane. It is necessary that the Lycra base have controlled stretch in both length and width in order for the two piece construction to achieve the skin tight exact fit required by golfers. The stretch in width should be about 100% and in length about 75% which allows the two piece glove to conform exactly to a wearer's hand.

The two cut pieces (FIG. 1) are joined together with one common seam either by laser bonding or heat bonding. The two pieces can also be joined by sewing but in that case it is necessary to seal the single seam which is less desirable but, still practical, unlike seam sealing an eight piece glove.

Another object of the invention is to provide a waterproof two piece glove.

Still another object of the invention is to provide a two piece form fitting glove which seals around a wearer's hand.

A further object of the invention is to provide a form for a glove adapted to form with a similar form to a two piece glove.

Yet still a further object of the invention is to provide an improved two piece glove which can be sealed along a single seam against water or other liquid penetration without negatively effecting the flexibility of the glove.

Yet still another object of the invention is to provide an improved two piece glove which can be sealed along a single seam against water or other liquid penetration without significant additional processing.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
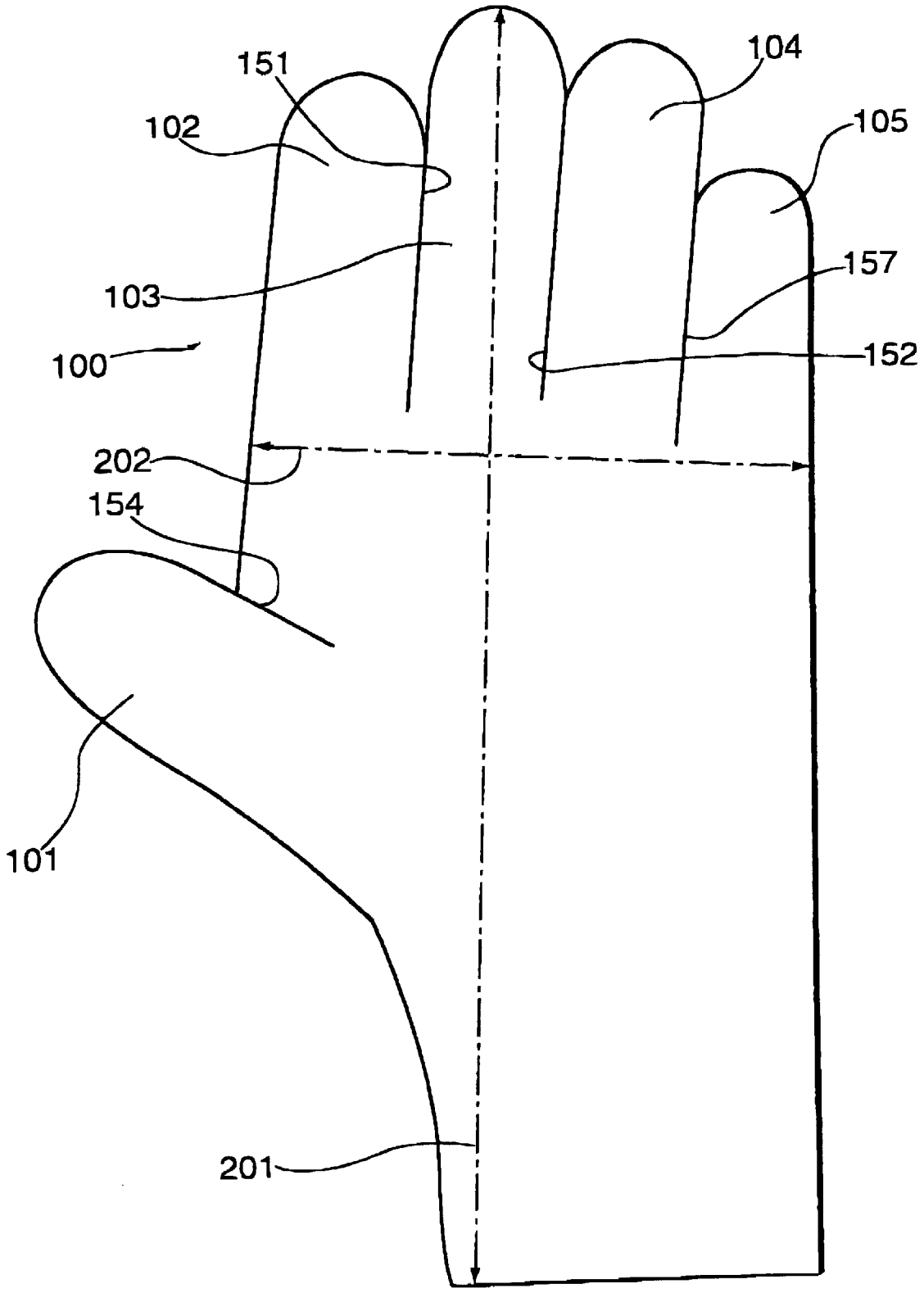
FIG. 1 is a top plan view of a glove pattern used for each of the two pieces of the waterproof breathable golf glove constructed in accordance with a preferred embodiment of the invention.

The glove pattern shown in FIG. 1, and generally indicated as 100, is designed to be attached to an identical piece to form a two piece glove. The two pieces are joined around the periphery of the glove and around each of the fingers, either by heating, ultra-sonic or other energy bonding or even gluing. It is also possible to sew the pieces together, although this is not necessary and would then require sealing of the seam to provide a waterproof barrier. The pattern shown is about 24.1 cm from the tip of the middle finger to the base of the pattern, as shown by dotted arrow 201 (and generally referred to as the length of the pattern) and about 13.8 cm across the fingers, as shown by dotted arrow 202 in FIG. 1 (and generally referred to as the width of the pattern). The lines shown between the fingers 151, 152, 153 and between the thumb and index finger 154 are cuts made in the pattern along which the glove may flex. The glove pattern includes thumb 101 and fingers 102, 103, 104 and 105. When assembled, the glove is a traditional form-fitting glove except that the thumb stall is at an unusual angle requiring the wearer to twist the thumb to make it seat properly on the finger without stress. In a preferred embodiment, the pattern is formed out of a Lycra based synthetic leather formed by coating knitted Lycra fabric with a film of polyurethane. In a preferred embodiment, the Lycra base should have a controlled stretch in both the length and width in order for the two piece construction to achieve the skin-tight exact fit required by golfers in connection with golf gloves and other precision uses. The glove may also be utilized for surgical purposes or in other industrial or sporting settings requiring a close fitting thin glove or prophylactic layer. In a preferred embodiment the glove stretches more in the width direction then in the length direction. Preferably, the glove stretches 50–150% in the width direction and 40–100% in the length direction; more preferably 75–125% in the width direction and 50–80% in the length direction; and even more preferably about 100% in the width direction and about 75% in the length direction.

The construction utilizing the pattern in accordance with the invention is valuable for non-waterproof golf gloves as well because it provides for a very low cost cutting and construction, is very durable because it has only one seam, and is generally lighter weight and more flexible because additional seams constrict movement.

Prior two piece glove constructions have failed to create a glove which fits snugly around a wearer's hand due to the variability of the hand geometry and the difficulty of conforming a two dimensional pattern to a three dimensional hand. Also, the breathable nature of the fabric does not make the hand hot and sweaty like a rubber or latex glove.

However, the combination of the pattern shown in FIG. 1 and a material which is stretchable along the length and the width of the directions provides a skin-tight material. Generally, two part prior art gloves have the thumb portion stretching in the wrong direction. This is corrected by the pattern and materials described herein.

The glove can be manufactured in a single mechanical set-up in which two layers of the material are placed over the other and are simultaneously or consecutively laser cut and bonded to further enhance the efficiency of the construction process.

In addition, the palm and back sections can be cut from different materials. For example, the palm can be cut from a highly tacky surface of Lycra and polyurethane and the back can be cut from a lighter weight, softer and cooler Lycra based polyurethane. The bonding or attaching process would be the same.

The dimensions of the glove pattern can be adjusted for different sized hands. However, due to the stretchable material utilized, fewer different sized patterns can be used than would be normally required of relatively non-stretchable materials such as natural or synthetic leather.

Accordingly, an improved two piece glove pattern and two piece glove which may be waterproof and breathable which is more easily and efficiently manufactured is provided. The glove's manufacturing can be completely or partially mechanized such that labor costs associated with glove manufacture, which traditionally form a large component of the cost of the gloves, can be substantially eliminated. In addition, the gloves provide a snug two piece fit which allows for the gloves, and particularly golf gloves, to be waterproof, which has not been traditionally possible with golf gloves due to the large number of seams generally required.

It will thus be seen that the objects set forth above, among those made apparent in the proceeding description, are efficiently obtained and, since certain changes may be made in the above constructions and processes without departing from the spirit and scope of the invention, it is intended that all matter contained in the above description or shown in the accompanied drawings shall be interpreted as illustrative, and not in the limiting sense.

It will also be understood that the following claims are intended to cover all of the generic and specific features of the invention, herein described and all statements of the scope of the invention which, as a matter of language, might be said to fall therebetween.

What is claimed is:

1. A glove comprising two single glove pattern panels, each of which has four straight edged finger panels and a thumb panel, the thumb panel being formed from the base of the index finger panel; at least one of the glove pattern panels being formed of a stretchable material, stretchable along the length and the width of the glove panel wherein the stretchable material stretches more across the width of the glove pattern panel than along its length; and sealing means for securing the two glove pattern panels to each other about the entire periphery of both of the glove pattern panels;

whereby a form-fitting two piece glove is formed.

2. The glove of claim 1 wherein the thumb panel is separated from the index finger panel by a cut forming an angle with the straight edges of the index finger panel.

3. The glove of claim 1 wherein each of the two glove pattern panels is formed of a waterproof breathable material.

4. The glove of claim 3 wherein the sealing means provides a waterproof bonding of the two glove pattern panels about a single seam.

5. The glove of claim 3 wherein the sealing means is a laser bonding of the two layers to each other.

6. The glove of claim 3 wherein the sealing means is an ultrasonically formed bond between the two glove pattern panels around their periphery.

7. The glove of claim 3 wherein the sealing means is a sewn bond covered by a waterproof tape or covering.

8. The glove of claim 1 wherein the sealing means provides a waterproof bonding of the two glove pattern panels about a single seam.

9. The glove of claim 1 wherein the glove patten panel stretches between about 50 and 150% of its unstretched size in the width direction and between 40 and 100% in the length direction.

10. The glove of claim 1 wherein the glove patten panel stretches about 100% of its unstretched size in the width direction and about 75% in the length direction.

11. The glove of claim 1 wherein the two glove pattern panels are formed from different materials.

12. The glove of claim 11 wherein the glove pattern panel forming the palm of the glove is formed of a heavier material than the glove pattern panel forming the back of the glove.

* * * * *